United States Patent [19]

Hoshino

[11] 4,346,638

[45] Aug. 31, 1982

[54] FOOT OPERATED DRUM PEDAL

[75] Inventor: Masao Hoshino, Owariasahi, Japan

[73] Assignee: Hoshino Musical Instrument, Manufacturing Co., Ltd., Owariasahi, Japan

[21] Appl. No.: 235,711

[22] Filed: Feb. 18, 1981

[30] Foreign Application Priority Data

Oct. 9, 1980 [JP] Japan ..... 55-144367[U]

[51] Int. Cl.[3] ..... G10D 13/00

[52] U.S. Cl. ..... 84/422 R

[58] Field of Search ..... 84/422 R, 422 C

[56] References Cited

U.S. PATENT DOCUMENTS

| | | | |
|---|---|---|---|
| 922,706 | 5/1909 | Ludwig | 84/422 C |
| 2,800,828 | 7/1957 | Moeller | 84/422 R |
| 3,797,356 | 3/1974 | Duffy et al. | 84/422 R |
| 4,186,644 | 2/1980 | Kurosaki | 84/422 R |

FOREIGN PATENT DOCUMENTS

| | | | |
|---|---|---|---|
| 2300381 | 2/1975 | France | 84/422 R |

*Primary Examiner*—Lawrence R. Franklin

*Attorney, Agent, or Firm*—Armstrong, Nikaido, Marmelstein & Kubovcik

[57] ABSTRACT

A foot-operated drum pedal is composed of a rocker constituted in a sprocket, and a chain connecting between the sprocket and the toe end of a pedal element. In the foot-operated pedal, a block and an inverse U-shaped bracket are attached respectively to both ends of the chain using pins, the block is screwed to the toe end of the pedal element and the bracket is screwed to and grips the sprocket, and a machine screw which is inserted between rollers of the chain disposed along the block is screwed to the block.

2 Claims, 4 Drawing Figures

FOOT OPERATED DRUM PEDAL

BACKGROUND OF THE INVENTION

1. Field of the Invention

The present invention relates to a foot-operated drum pedal and more particularly to a foot-operated pedal characterized in the connecting structure of a pedal element with a rocker.

2. Description of the Prior Art

In a conventional foot-operated drum pedal, connection between a pedal element and a rocker rotating integrally with a beater carrying member was usually carried out using a leather strap screw connected at both ends. This connecting method has a disadvantage in that elongation of attaching holes on the leather strap and of strap itself during use makes it difficult for the slanting angle of the pedal element to be held at a prescribed value, and finally the attaching holes may be broken.

In order to overcome this disadvantage, U.S. Pat. No. 3,797,356 as shown in FIG. 4 of the present application discloses a rocker constituted in a sprocket 1 which is connected to the toe end of a pedal element 2 through a chain 3. One end of the chain 3 is connected to a mounting means 5 with a slot 4 at the toe end of the pedal element 2 using a pintle 6; the other end thereof is connected to one of a plurality of bores 7 spaced at regular intervals on the sprocket 1 using a drive pin 8.

In this construction, the chain is not elongated during working as in the case of a leather strap therefore the slanting angle of the pedal element is held to a prescribed value. However, the pintle 6 is directly subjected to a shock load during the foot pedal operation, and thus elongation of the bore may result in the pintle coming out of the bore or the chain 3 may bounce and, therefore, the pedal operation is not always carried out smoothly. Furthermore, rearrangement of the bore in the mounting means 5 is required when the pintle 6 comes out of the bore, and this work is troublesome.

SUMMARY OF THE INVENTION

An object of the present invention is to provide a foot-operated drum pedal, comprising a rocker mounted on a sprocket, and a chain connected between the sprocket and toe end of a drum element, wherein the chain is screwed to the toe end of the pedal element through a block, and a machine screw is inserted between rollers of the chain disposed along the block and screwed to the block, thereby a pintle is not subjected to shock load as in conventional manner but the rollers of the chain receive most of the shock load so that the pintle in the mounting means of the pedal element is prevented from coming loose.

Another object of the present invention is to provide a foot-operated drum pedal, wherein a chain having a block and a bracket at both ends to be screwed respectively to a pedal element and a sprocket is constructed as a unit, thereby in case of the chain failure at an intermediate portion, the chain is easily removed and repaired.

A further object of the present invention is to provide a foot-operated drum pedal wherein a slip preventing means is attached to a bracket through an arc-shaped arm, whereby bouncing of the chain during the pedal operation is almost completely eliminated and the pedal operation is carried out smoothly.

DESCRIPTION OF THE PREFERRED EMBODIMENT(S)

Figure 1:
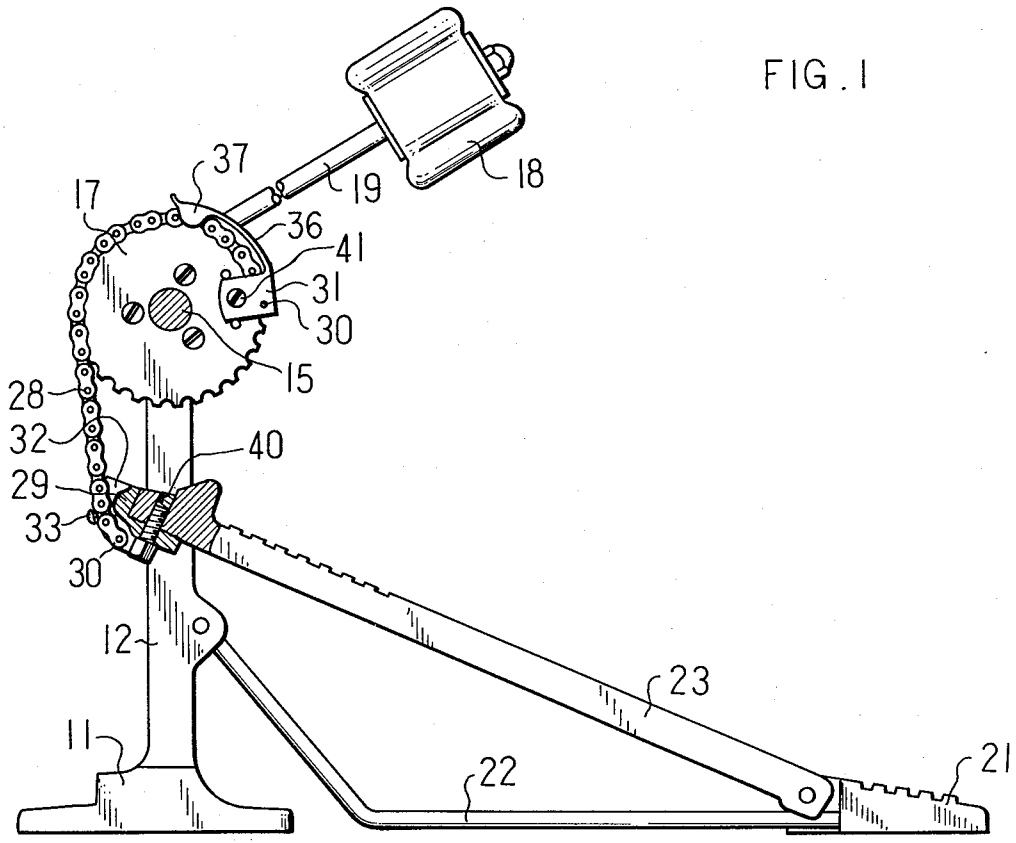
FIG. 1 is a side view partly in section of a foot-operated drum pedal in an embodiment of the invention.
Figure 2:
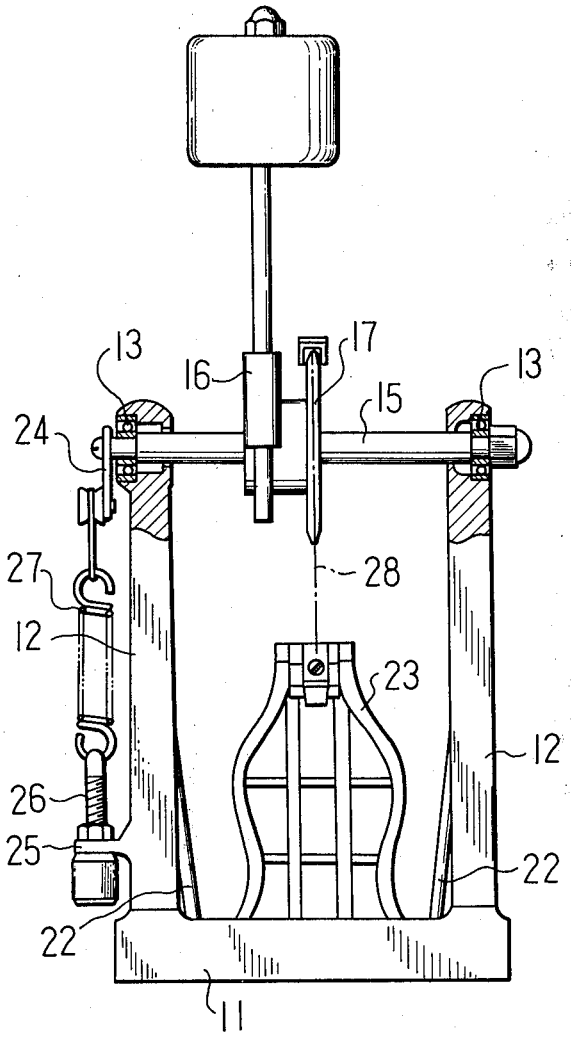
FIG. 2 is a front view partly in section of the foot-operated drum pedal in FIG. 1.
Figure 3:
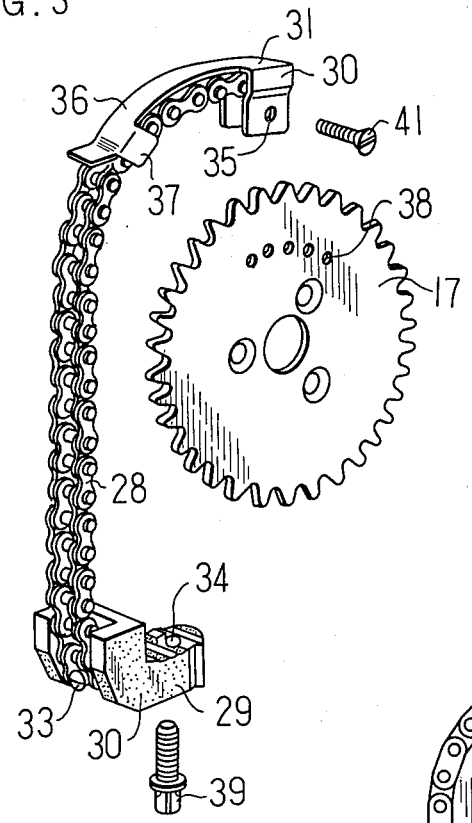
FIG. 3 is a fragmentary view of a chain separated in parts illustrating the connecting structure of the chain in the foot-operated drum pedal in FIG. 1.
Figure 4:
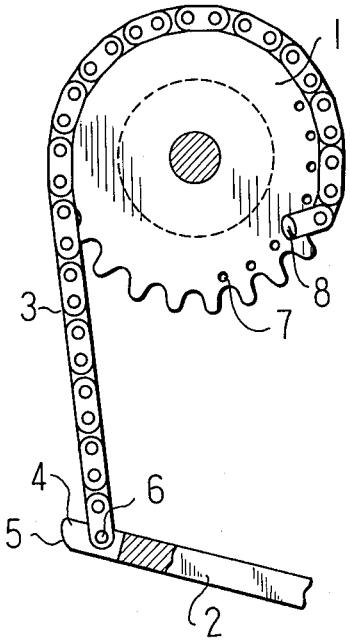
FIG. 4 PRIOR ART
FIG. 4 is a side view of a chain illustrating the connecting structure of the chain in the foot-operated drum pedal in prior art.

An embodiment of the present invention is now to be described referring to FIGS. 1–3.

A foot-operated drum pedal comprises a base 11, support poles 12, 12 disposed on both sides of the base 11, ball bearings 13, 13 mounted respectively on the upper ends of the poles 12, 12, and a rotating shaft 15 disposed between the ball bearings 13, 13. A beater carrying member 16 are fixed on the center of rotating shaft 15 and a rocker or sprocket 17 rotating integrally with the beater carrying member 16. The beater carrying member 16 is provided with a beater 19 having a striking pad on the top end thereof.

A heel 21 is arranged on the rear side of the base 11. Both sides of the top end of the heel 21 are connected respectively to the intermediate portions of the poles 12, 12 through resilient arms 22, 22, and the resilient arm 22 pivotally connects the heel 21 and the pole 12 respectively. A pedal element 23 is connected to the base portion of the heel 21 using pins. A sector 24 is secured to the left projection of the rotating shaft 15 as shown in FIG. 2. A bracket 25 projects leftwards from the lower portion of the pole 12. A return coil spring 27 is interposed between the sector 24 and an adjusting bolt 26 attached to the bracket 25.

The toe end of the pedal element 23 is connected to the sprocket 17 through a chain 28 whereby the slanting angle of the pedal element 23 may be adjusted as hereinafter described in detail.

Both ends of the chain 28 are provided with an L-shaped block 29 and an inverse U-shaped bracket 31 respectively connected thereto using pins 30. At the center of the block 29 is formed a slot 32 along which the chain 28 may be fitted. A machine screw 33 is inserted between rollers of the chain 28 within the slot 32 and secured to the block 29. A bolt hole 34 is arranged on the block 29 to the side along which the chain 28 is not moved. Both sides of the lower portion of the inverse U-shaped bracket 31 are provided with holes 35, 35 one of which is tapped. A U-shaped slip preventing member 37 is formed at the top end of the bracket 31 in the extending direction of the chain 28 through an arc-shaped arm 36 surrounding the sprocket 17.

The chain 28 has the block 29 at one end and the bracket 31 at the other end and is attached to the pedal element 23 as follows. First a bolt 39 is inserted through the bolt hole 34 of the block 29 into threaded hole 40 on the bottom of the toe end of the pedal element 23. Next the chain 28 is pulled, the slanting angle of the pedal element 23 is adjusted, the chain 28 is hung to the sprocket 17, and bracket 31 is attached to the sprocket 17 through one of the plurality of holes 38 on the sprocket 17 using a machine screw 41.

What is claimed is:

1. A foot-operated drum pedal, comprising a sprocket, and a chain connecting between the sprocket and the toe end of a pedal element, wherein a block and an inverse U-shaped bracket are attached respectively to both ends of the chain using pins, and wherein said block is screwed to the toe end of the pedal element, said bracket is screwed to and grips the sprocket, and a machine screw is inserted between the rollers of the chain disposed along the block and screwed into the block.

2. A foot-operated drum pedal according to claim 1, wherein a slip preventing means is attached to the bracket through an arch-shaped arm.

* * * * *